US005699690A

United States Patent [19]

Furugen et al.

[11] Patent Number: 5,699,690

[45] Date of Patent: Dec. 23, 1997

[54] METHOD AND APPARATUS FOR MANUFACTURING HOLLOW STEEL BARS

[75] Inventors: Munekatsu Furugen, Nishinomiya; Shotaro Hamazaki, Ibaragi; Norimasa Kameoka; Atsuhumi Okamoto, both of Amagasaki, all of Japan

[73] Assignee: Sumitomo Metal Industries, Ltd., Osaka, Japan

[21] Appl. No.: 661,700

[22] Filed: Jun. 11, 1996

[30] Foreign Application Priority Data

Jun. 19, 1995 [JP] Japan ..... 7-151623

[51] Int. Cl.[6] ..... B21B 19/04

[52] U.S. Cl. ..... 72/69; 72/97

[58] Field of Search ..... 72/69, 96, 97, 72/202, 342.5, 342.6

[56] References Cited

U.S. PATENT DOCUMENTS

| | | | |
|---|---|---|---|
| 1,993,427 | 3/1935 | Widuch | 72/96 |
| 2,264,455 | 12/1941 | Peck | 72/97 |
| 4,510,787 | 4/1985 | Hayashi et al. . | |

FOREIGN PATENT DOCUMENTS

| | | | |
|---|---|---|---|
| 0 119 154 | 9/1984 | European Pat. Off. . | |
| 2 529 482 | 1/1984 | France . | |
| 59-004905 | 1/1984 | Japan . | |
| 59-4905 | 1/1984 | Japan . | |
| 63-123517 | 5/1988 | Japan . | |
| 4-135004 | 5/1992 | Japan . | |
| 440429 | 8/1974 | U.S.S.R. | 72/342.5 |
| 1616733 | 2/1989 | U.S.S.R. . | |

OTHER PUBLICATIONS

Iron and Steel Handbook, vol. 3, 2, Iron and Steel Association of Japan, Jan. 1982, pp. 984–996.

Evans et al., "Diescher—The Mill for Tomorrows's Quality", *Iron and Steel Engineer*, Feb. 1968, pp. 93–98.

*Primary Examiner*—Lowell A. Larson

*Attorney, Agent, or Firm*—Burns, Doane, Swecker & Mathis, LLP

[57] ABSTRACT

A method of manufacturing hollow steel bars comprising the steps of preparing a hollow billet with the dimensions meeting a condition expressed by the following formula (1) by piercing a steel billet with a piercer after heating, inserting a mandrel as an inner surface sizing tool into a hollow billet, and then rolling the hollow billet on a cross-rolling mill having three rolls arranged around a pass line to provide plastic working for reduction of the outside diameter and adjustment of the wall thickness of the hollow billet so as to meet a condition expressed by the following formula (2), and a manufacturing apparatus comprising an electric resistance heating unit, the piercer, and the cross-rolling mill, wherein $$t_0/d_0>0.1 \quad (1)$$

$$Rt<0.55Rd \quad (2)$$

where $t_0$=wall thickness of hollow billet before cross rolling $d_0$=outside diameter of hollow billet before cross rolling Rt=wall thickness reduction (%), $Rt=(t_0-t_1)/t0\times100$ Rd=outside diameter reduction (%), $Rd=(d_0-d_1)/d_0\times100$ $t_1$=wall thickness of hollow steel bar after cross rolling d1=outside diameter of hollow steel bar after cross rolling By means of such a method and system as stated above, long and thick-walled hollow steel bars of small diameter, approximately, 20–70 mm in the outside diameter, 0.25–0.40 in the wall thickness to outside diameter ratio ($t_1/d_1$), and 2–6 m in length, can be produced with high dimensional accuracy and at low cost.

7 Claims, 6 Drawing Sheets

* passed time after current introduction

METHOD AND APPARATUS FOR MANUFACTURING HOLLOW STEEL BARS

BACKGROUND OF THE INVENTION

1. Field of the Invention

This invention relates to a method and an apparatus for manufacturing hollow steel bars by means of a 3-roll cross-rolling mill, and more particularly to the manufacturing of thick-walled hollow steel bars, small in diameter and long in length, having a wall thickness to outside diameter ratio at 0.25 or higher, outside diameter of 20–70 mm, and length of 2 m or longer.

2. Description of the Prior Art

Thick walled hollow steel bars of small diameter are in wide use as one of the structural materials for automobiles, industrial machines and others. The hollow bars are suited for use as various shafts in the automobile, for example, input shaft, pinion shaft or the like. There have been two known methods of manufacturing thick-walled hollow steel bars of small diameter having a wall thickness to outside diameter ratio of 0.25 or above; one is a mechanical working process and the other is a plastic working process.

As for mechanical working, there is a process wherein thick-walled hollow steel bars of small diameter are manufactured by drilling steel billets mechanically with a gun drill or the like, but this process is not suited for industrial production of long hollow steel bars because of high production cost and poor dimensional accuracy in drilling billets 1 m or more in length.

There are four typical conventional methods of manufacturing hollow steel bars and seamless tubes by plastic working:

1) First Method

FIG. 3 shows a process of manufacturing thick-walled hollow steel bar by a grooved-roll rolling line. This is a process wherein a square hollow steel billet B2 is formed by mechanical working of a square steel billet B1 using a drill 16 as shown in FIG. (*a*), a core bar 7 made of metal having a high co-efficient of thermal expansion such as high manage steel or the like is inserted into the hollow steel billet as shown in FIG. (*b*), the hollow steel billet is heated to a predetermined temperature in a reheating furnace as shown in FIG. (*c*), and rolled to predetermined dimensions by a grooved-roll rolling line as shown in FIG. (*d*), producing a hollow steel bar B3 by withdrawing the core bar 7 after the hollow steel billet is cooled as shown in FIG. (*e*). However, the process of manufacturing hollow steel bars through a grooved-roll rolling line as shown in FIG. 3 has some problems; for example, deterioration in dimensional accuracy due to the thickness deviation of a product resulting from plastic deformation of the core bar 7 itself during rolling on the grooved-roll rolling mill, and unsuitability of the core bar 7 for reuse due to plastic deformation resulting in high unit tool requirement and high production cost.

2) Second Method

FIG. 4 is a schematic view showing a process of manufacturing relatively thick-walled seamless tubes, so-called rolling by Assel mill.

This is a cross-rolling process, using a mandrel as an inner surface sizing tool, which is fully explained in Iron and Steel Handbook, vol. 3, 2, P. 984–P. 996 (published by Iron and Steel Association of Japan, January, 1982). This process is explained hereafter referring to said literature. The Assel rolling is said to be suited for manufacturing relatively thick-walled tubes among seamless tubes, particularly, tubes for use as bearings.

As shown in FIG. 4(*b*), a round billet C1 is heated up to a predetermined temperature in a rotary hearth-type reheating furnace, as shown in FIG. (*c*), a bore is formed in the heated billet C1 by a piercer forming a tube stock C2, bad as shown in FIG. (*d*), the tube stock C2 having a mandrel 8 inserted therein is rolled on Assel mill incorporating rolls 9, each having a surface formed in a specific shape with a so-called "hump", whereby both the outside diameter and wall thickness of the tube stock C2 is reduced, producing a tube workpiece C3. The mandrel 8 is withdrawn from the tube workpiece C3 after rolling, as shown in 4(*e*), the tube workpiece C3 is then heated in a reheating furnace, and, as shown in FIG. (*f*), further reduced in the outside diameter on a sinking mill producing a semifinished tube C4. As shown in FIG. (*g*), the outside diameter of the semifinished tube C4 is finished to a target size on a rotary sizer; and a finished product C5 is thus obtained.

In manufacturing a thick-walled hollow steel bar by the Assel mill as shown in FIG. 4, the following problems are encountered.

FIG. 5 is a sectional view of a workpiece being rolled on the Assel mill showing rolls 9 each having a bulged surface with the hump 16 of a height h, the tube stock C2 before rolling, the tube workpiece C3, and the inner surface sizing tool 8.

The main feature of the Assel rolling process is to roll the workpiece on the rolls each having the aforesaid hump and the function of the hump is said to provide plastic working to rapidly reduce the wall thickness of a workpiece thereby so that rolling is achieved while expansion of the workpiece toward the peripheral surface is prevented by virtue of elongation in the axial direction of the workpiece. When a thick-walled workpiece is rolled by rolls without the hump, there is a possibility of the dimensional accuracy of a product tube deteriorating due to expansion of the workpiece toward the peripheral surface, leading in an extreme case to the interruption of rolling operation due to cross-sectional triangulation of the workpiece occurring when the rear end of the workpiece is rolled.

In the hump region, the magnitude of outside diameter reduction and wall thickness draft, respectively, is considered approximately equal to the height of the hump h. Therefore, the wall thickness reduction Rt is greater than the outside diameter reduction Rd.

In the case of Assel rolling, a wall thickness to outside diameter ratio of a tube stock, $t_0/d_0$ is nearly equal to that of a tube workpiece as rolled, $t_1/d_1$, the latter being generally slightly smaller.

For production of a tube whose wall thickness to outside diameter ratio undergoes a change between times before rolling and after rolling, it is necessary to pierce the tube stock such that $t_0/d_0$ at the piercing stage is close to $t_1/d_1$ after rolling.

This follows that for production of a tube workpiece having a high $t_1/d_1$ ratio after rolling in the Assel mill, a $t_0/d_0$ value of the tube stock in the piercing stage needs to be sufficiently high, in other words, use of a plug rod of small diameter is necessitated in the stage of piercing by a piercer to secure a sufficient wall thickness of the workpiece as pierced, subjecting the plug rod to a risk of buckling depending on a thrust load during rolling. This puts limitations on processing of thick-walled tube stock with a piercer.

The Assel rolling process has other disadvantages in that the tube workpiece as rolled in the Assel mill needs to undergo further steps of processing; multi-steps such as reheating, reduction of the outside diameter in a sinking mill, and finishing up of the external shape by a rotary sizer for correcting the ovality in the cross-section of a product, naturally result in an increase in the production cost.

3) Third Method

In Japanese Patent Laid-open, JP. A No. 59-4905, a method of manufacturing a thick-walled hollow steel bar by forming a hollow steel billet by piercing a steel billet and then by rolling the hollow steel billet on a cross-rolling mill having three or four cone-shaped rolls for reduction of the outside diameter and wall thickness of the workpiece to target dimensions without use of an inner surface sizing tool is disclosed.

The method described in the said JP. A is characterized by cross-rolling of a workpiece without an inner surface sizing tool inserted therein; thick-walled tubes of small diameter can be produced to target sizes by varying the combination of cross angles and feed angles in this process. However, according to the results of tests and research made by the inventor of the invention, et al., it has turned out that the dimensional accuracy of a product deteriorates due to instability of the shape of the inner surface of the hollow steel billet subjected to free deformation during rolling without use of the inner surface sizing tool. Therefore, it can be said that this process is suited for manufacturing hollow steel bars for which strict dimensional accuracy is not required but not for hollow steel bars requiring high dimensional accuracy.

4) Fourth Method

In Japanese Patent Laid-open, JP. A 4-135004, a cross-rolling method of manufacturing seamless tubes to target dimensions by reducing the outside diameter and wall thickness of a tube stock with use of a plug as an inner surface sizing tool on a 3-rolls cross-rolling mill is disclosed.

The inventor ran tests to confirm a feasibility of rolling a workpiece into a thick-walled hollow steel bar of small diameter having a wall thickness to outside diameter ratio ($t_1/d_1$) of 0.25 or higher.

A rolling test using a plug 14 mm in diameter as an inner surface sizing tool was conducted on a hollow billet 2800 mm long and made of S45C steel to obtain the outside diameter of 35 mm under the condition of a ratio of wall thickness draft (Rt) to diameter reduction ratio (Rd) being Rt/Rd=0.167. The test results showed that seizure occurred on the plug at a point 800 mm away from the inlet side; the investigation for the cause thereof disclosed that when the workpiece was rolled with the plug inserted therein, the compressive force of rolling acted on the localized area only of the surface of the plug, using up hot working lubricant applied to the plug even if sufficiently applied.

Accordingly, it can be said that this is not a practical method suited for manufacturing long hollow steel bars.

SUMMARY OF THE INVENTION

Thick-walled hollow steel bars having excellent toughness are in wide use for transmission shaft and drive shaft used in the automobile, various other hollow shafts, rock drilling shafts or the like. It is an object of the present invention to provide a method and an apparatus for manufacturing such hollow steel bars as stated above having the outside diameter in the range of 20–70 mm, the wall thickness to outside diameter ratio ($t_1/d_1$) in the range of 0.25–0.4, and the length in the order of 2–6 m with high dimensional accuracy and at low cost. The invention created in view of the problems mentioned in the foregoing is briefly explained hereafter.

1. A method of manufacturing a hollow steel bar comprising steps of:

heating a steel billet;

forming a bore in the heated billet with a piercer to form a hollow workpiece meeting a condition expressed by the following formula (1);

inserting a mandrel serving as an inner surface sizing tool into the hollow workpiece; and cross-rolling the hollow workpiece having the mandrel inserted in the bore for cross-rolling by a cross-rolling mill having three rolls arranged around a pass line for a diameter reduction process and a wall thickness sizing process meeting a condition expressed by the following formula (2) wherein $$t_0/d_0 \geqq 0.1 \quad (1)$$

$$Rt < 0.55Rd \quad (2)$$

where $t_0$=the wall thickness of the hollow billet (workpiece) before cross-rolling $d_0$=the outside diameter of the hollow billet before cross-rolling Rt=wall thickness reduction (%), $Rt=(t_0-t_1)/t_0\times100$ Rd=outside diameter reduction (%), $Rd=(d_0-d_1)/d_0\times100$ $t_1$=the wall thickness of the hollow steel bar after cross-rolling $d_1$=the outside diameter of the hollow steel bar after cross-rolling 2. A method of manufacturing a hollow steel bar as stated under 1 above, wherein a steel billet is heated through electric resistance heating by keeping the protruding tips of electrodes securely pressed against the surface at respective ends of the billet.

3. A method of manufacturing hollow steel bar as stated under 2 above, wherein electric resistance heating of a steel billet is commenced by keeping the protruding tips of electrodes pressed securely against respective ends of the billet while cooling the surface at respective ends of the billet and the circumferential surface of the billet up to a distance of 0.3–2.5 times the outside diameter thereof; such cooling being stepped so as not to excessively cool said cooled parts of the billet prior to completion of said electric resistance heating so that the billet is heated to a target temperature.

4. An apparatus for manufacturing hollow steel bar comprising;

means for electric resistance heating provided with electrodes, the protruding tips thereof being kept securely pressed against the surface of respective ends of a steel billet, means for cooling respective ends of a steel billet, a piercer for forming a hollow workpiece by piercing the heated steel billet a cross-rolling mill having three rolls arranged around a pass line processing the hollow workpiece having a mandrel inserted therein for a diameter reduction working and a wall thickness sizing working.

The wall thickness sizing working stated above includes both a process to reduce the wall thickness and a process to increase the wall thickness.

BRIEF DESCRIPTION OF THE DRAWING

FIG. 2(*b*) is a cross-sectional view along the section line 2(*b*) in FIG. 2(*a*).

FIG. 2(*c*) is a cross-sectional view along the section line 2(*c*) in FIG. 2(*a*).

DETAILED DESCRIPTION OF THE INVENTION

Figures 1A, 1C, 1D:
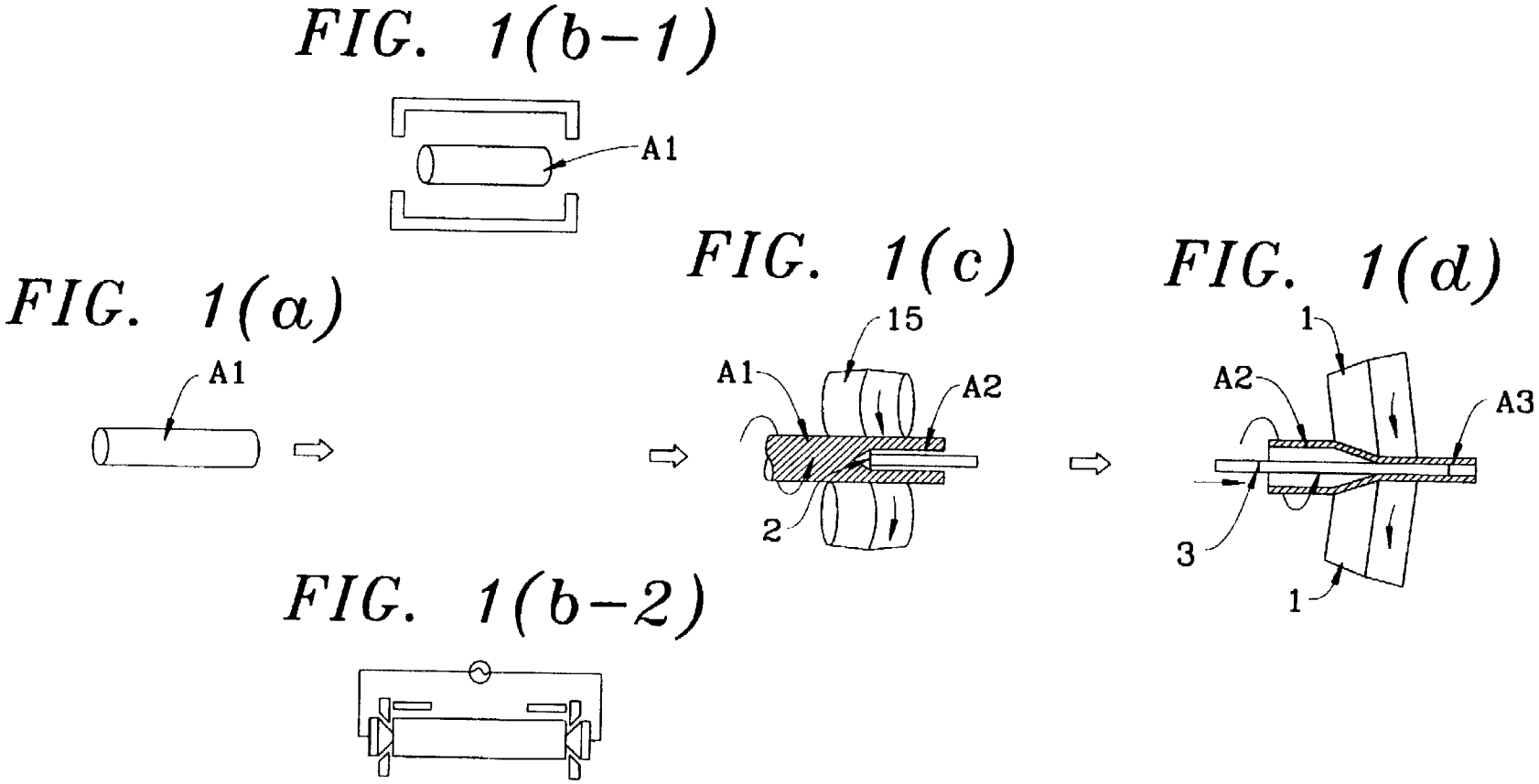
FIGS. 1(*a*), 1(*b*-1), 1(*b*-2), 1(*c*) and 1(*d*) together constitute a schematic view showing the method of the present invention for manufacturing a hollow steel bar.

The inventors of the present invention conducted a series of tests and examined the test results to develop a method of manufacturing a thick-walled hollow steel bar of small diameter having excellent toughness with high dimensional accuracy and at low cost by use of a cross-rolling mill. Subsequently, they have acquired the following information on a cross-rolling process for production of a thick-walled hollow steel bar having a wall thickness to outside diameter ratio ($t_1/d_1$) in the range of 0.25–0.40:

A) Use of a hollow workpiece having a wall thickness to outside diameter ratio ($t_0/d_0$) of 0.1 or above is essential to prevent the hollow workpiece from undergoing polygonalation, that is, cross-sectional deformation into a substantially pentagonal shape in the course of rolling.

B) The dimensional accuracy of a rolled product is dependent on a ratio of wall thickness reduction (Rt) to outside diameter reduction (Rd), namely, Rt/Rd.

As soon as the Rt/Rd value rises to 0.55 or above, the dimensional accuracy deteriorates significantly and marks in a spiral pattern appear on the inner surface of the hollow workpiece.

C) The product being thick-walled and small in diameter, a mandrel used as an inner surface sizing tool is necessarily small in diameter and the load acting on the mandrel during rolling operation becomes very large.

Accordingly, the magnitude of a working for wall thickness reduction needs to be as small as possible in comparison with that for a working for diameter reduction so that a condition of Rt<0.55 Rd is met.

D) A hollow steel bar can be obtained with high dimensional accuracy by cross-rolling a hollow workpiece, having a mandrel inserted therein, on condition that the ratio ($t_0/d_0$) is 0.1 or above and the the ratio (Rt/Rd) is 0.55 or below.

Moreover, a process for dimensional correction can be dispensed with.

E) A product having excellent toughness can be obtained by adopting a direct electric resistance heating method in place of a heating method using a reheating furnace of the conventional gas combustion type.

The reasons for specifying the operating conditions as set out in the invention and the operation of the invention are described hereafter.

(1) Cross-rolling with Three Cone-Shaped Rolls

Rolling of a hollow workpiece with two cross-rolls allows the workpiece to expand where it is not in contact with the rolls and, for prevention of such expansion, guide shoes are required. But, this poses a risk of the external surface of the workpiece being marred when the said surface comes in contact with the guide shoes. Therefore, it is not desirable to employ the two-roll cross-rolling process.

On the other hand, in the case of cross-rolling with four rolls, the diameter of respective rolls needs to be reduced for structural reasons. But when rolling a thick-walled hollow billet of small diameter, the load on respective rolls becomes quite high.

In consideration of the strength of the rolls, such a process is not suited for the purpose. It was found that only three-roll cross-rolling could process the workpiece without causing any defect on the surface thereof withstanding high loads acting on the rolls when processing a thick-walled workpiece of small diameter. Therefore, the invention defines rolling by cross-rolling with three rolls.

(2) Inner Surface Sizing Tool

Use of a mandrel as an inner surface sizing tool is intended to finish up a hollow steel bar with high dimensional accuracy and also to prevent occurrence of seizure which a long workpiece is liable to undergo.

As soon as reduction in the outside diameter of the workpiece occurs due to rolling, the inside diameter thereof is naturally reduced as well; whereupon the inner surface of the workpiece is allowed to deform freely until it comes in contact with a mandrel. Consequently, as soon as reduction in the outside diameter occurs, the inside diameter of the workpiece undergoes dimensional variation in a spiral fashion as cross-rolling with three rolls proceeds. But when the mandrel comes in contact with the inner surface of the workpiece, deformation of the inner surface is restrained by the mandrel, enabling the inside diameter to be finished with high dimensional accuracy. Further, as the mandrel moves forward in the same direction as the rolling direction during rolling, part of the surface of the mandrel which comes in contact with the workpiece in the elongation region always represents a new surface, thus preventing seizure from occurring between the workpiece and the mandrel.

(3) $t_0/d_0 \geqq 0.1$

When a $t_0/d_0$ value is less than 0.1, polygonalation of the workpiece, that is, cross-sectional deformation of the workpiece into a substantially pentagonal shape, occurs. Therefore, the minimum value of $t_0/d_0$ is set at 0.1. It is desirable to set the $t_0/d_0$ value at 0.12 or above to prevent polygonalation of the workpiece during rolling. No particular value is set as the upper limit of $t_0/d_0$ but a maximum value in the order of 0.25 is preferred in forming a thick-walled hollow workpiece by a piercer because of an increasing risk of a plug rod buckling as the wall thickness increases.

(4) Rt<0.55 Rd

This restriction is important in realization of cross-rolling with high dimensional accuracy of a hollow billet having a mandrel inserted therein. The larger an increase in the reduction of wall thickness Rt is, the greater the magnitude of expansion of the workpiece toward the external surface thereof deteriorating dimensional accuracy. The dimensional accuracy is dependent on a ratio of wall thickness reduction Rt to outside diameter reduction Rd (Rt/Rd), and deteriorates when Rt/Rd increases to 0.55 or above; furthermore, as marks in a spiral pattern are left on the inner surface of the workpiece, Rt/Rd is restricted to less than 0.55 (Rt<0.55 Rd); preferably, Rt≦0.5 Rd.

The main object of cross-rolling of a hollow workpiece with a mandrel inserted therein as represented by Assel mill is normally to reduce the wall thickness of the workpiece and consequently not much working for diameter reduction is provided in this process, providing most of working for diameter reduction in the later step of the process. Therefore, in the case of the conventional cross-rolling process using a mandrel, the following relation exists;

$$Rt/Rd>1.0$$

This follows that the mandrel is subjected to high loads thermally and in terms of stress. In manufacturing a thick-walled hollow bar of small diameter having a wall thickness to diameter ratio ($t_1/d_1$) at 0.25 or higher and outside diameter in the range of 20–70 mm, which is an object of the invention, the diameter of the mandrel becomes inevitably smaller. If cross-rolling is carried out on the conventional condition, that is, Rt/Rd>1.0, for production of hollow steel bars having dimensions as stated above, the mandrel undergoes deformation, making it impossible to obtain high dimensional accuracy and, in an extreme case, interrupting rolling operation. From this viewpoint, Rt value should be less than 0.55 Rd; such restriction causes the mandrel to be heated up to a high temperature, but the stress due to the load acting on the mandrel becomes lower, enabling use of hot working tool steel of SKD 61 type for the mandrel.

Figure 6:
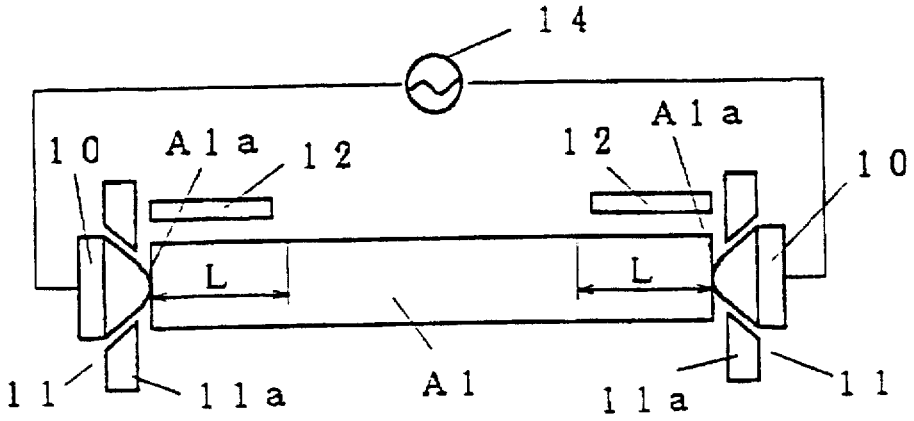
FIG. 6 is an electric resistance heating device and a cooling device used in the manufacturing method according to the invention.

(5) Electric Resistance Heating of a Steel Billet by Use of Electrodes with Protruded Tips FIG. 6 illustrates an electric resistance heating method. Protruded tips of electrodes 10 are securely pressed against the surface Ala at respective ends of a steel billet A1 so that electric current flowing from a power source 14 to the billet heats up the billet by heat generated due to electric resistance of the billet itself.

When a steel billet is heated in a reheating furnace of gas combustion type in common use, it takes longer to heat up the billet workpiece to a target temperature, resulting in a longer time in the reheating furnace; this will create a cause for excessive crystal growth and decarburization, resulting in somewhat lower toughness of a product.

In case of manufacturing a hollow steel bar for application where great importance is not attached to the toughness property thereof, heating of a workpiece in a reheating furnace of the conventional type will suffice. However, in cases where excellent toughness is required of a product, it is preferable to adopt an electric resistance heating method because of its very short heating time posing little risk of excessive crystal growth or decarburization occurring.

Further, use of electrodes, each having a protruding surface at one end where it is in contact with a steel billet, is preferable because an area of such contact between each electrode and the billet is minimized. In case of the contact area being large, heat generated in the billet is absorbed by the electrodes when the billet is heated to a high temperature, lowering the temperature at respective ends of the billet. This will result in uneven distribution of temperature in the longitudinal direction of the billet. Since, in case of the protruding surface of each electrode being a spherical shape, the adequate R value for a suitable spherical surface varies depending on the diameter of the billet, such an R value should be determined empirically.

The shape of protrusion at respective ends of each electrode is not restricted to any particular shape, but the tip of each electrode formed in the shape of an oval or a true circle is preferred; protrusion as a whole in the form of a sphere being preferred.

Use of electrodes of internal cooling type, inside of which cooling water is circulated, is desirable, but solid electrodes which are cooled by cooling water jetted through nozzles 11*a* for cooling respective ends of the billet as shown in FIG. 6 is also acceptable.

(6) Cooling of the Surfaces at Respective Ends of, and the Circumferential Surface of, a Steel Billet During Electric Resistance Heating Electric resistance heating is commenced while cooling water is sprayed on the surface at respective ends of a steel billet and the circumferential surface of the billet in a region up to 0.3–2.5 times the outside diameter of the same from the respective ends thereof.

When the billet is heated by current passed through electrodes against which the billet is securably pressed, the end portions of the billet are heated to an abnormally high temperature because the calorific value of heat generated in the end portions is grater than that in the middle portion due to the contact resistance developed in the contact surface of the billet; the higher the temperature of the billet, the greater the electric resistance of the billet becomes, causing the billet to generate more heat and rise further in its temperature. Therefore, it is desirable to prevent the end portions of the billet from attaining a high temperature by cooling the surface at respective ends of and the circumferential surface near the ends of the billet.

It is desirable to install a cooling device as shown in FIG. 6 comprising nozzles 11*a* for cooling the surface at respective ends of the billet, and other nozzles 12 for cooling the circumferential surface near respective ends of the billet. Also, it is desirable to position the nozzles for cooling the surface at respective ends of the billet such that cooling water injected through them can be sprayed on electrodes 10 as well, preventing the temperature of the electrodes from rising.

A series of tests as stated hereafter were run to determine an adequate length of a cooling region on the surface of the billet near respective ends thereof.

Electric resistance heating was applied to a steel billet 50 mm in outside diameter, and 1800 mm in length, made of S45C steel according to JIS, used as a testpiece, by impressing 28000 A on the testpiece for 90 sec. while varying the length of the water-cooled region on the surface of the testpiece in the range of 0.1–3.0 times the diameter of the testpiece from the respective ends thereof (flow rate of cooling water: to the end surfaces 15 l/min., to the circumferential surfaces near the respective ends 2.5 l/min.). Cooling with water was stepped after 65 sec. from the start of heating the testpiece with current, and the temperature distribution along the longitudinal direction of the testpiece was measured by a thermocouple embedded in the testpiece.

Figure 7:
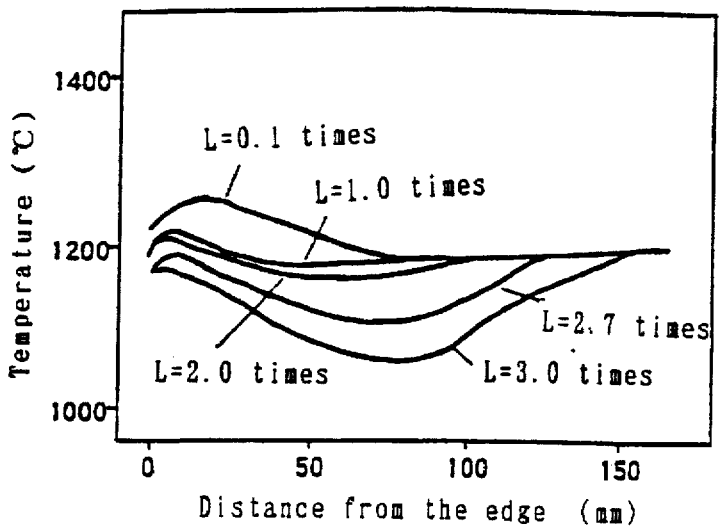
FIG. 7 is a graph showing distribution of temperature in the longitudinal direction of a steel billet when the steel billet is heated by the electric resistance heating device while respective ends of the billet are cooled.

FIG. 7 is a graph showing the results of temperature distribution measurement taken along the longitudinal direction of the testpiece. As shown clearly in said Fig., in the case of the length L of a cooled region being 0.1 times the diameter of the testpiece, the temperature at respective ends of the testpiece is much higher than that in the middle part thereof. In the case of the length L of the cooled region being 3 times the diameter of the testpiece, the middle part was found excessively cooled. The results of the aforementioned test confirmed that when the length of the cooled region is in the range from 0.3 to 2.5 times the diameter of the testpiece from the respective ends of the testpiece, the temperature at the respective ends was found to be nearly the same as the temperature in non-cooled parts of the testpiece, demonstrating even distribution of temperature throughout the whole length of the testpiece.

The surfaces at both ends of the testpiece need to be cooled because they are the contact surfaces between the testpiece and the electrodes and subject to heating to a high temperature.

(7) Cooling at the Start of Heating

Electric resistance heating is commenced while cooling water is being supplied. The reason for this is to improve cooling efficiency. More specifically, if cooling is commenced after the temperature at respective ends of the testpiece has risen by electric resistance heating, cooling efficiency will be drastically decreased due to a vapor film formed on the surface of the testpiece. Since the end portions of the testpiece are heated to high temperature in a short time due to contact resistance between the electrodes and the testpiece, it is desirable to supply cooling water prior to the start of electric resistance heating so that cooling can be started simultaneously with the start of electric resistance heating.

(8) Cooling at the End of Heating

Cooling is stopped prior to the termination of electric resistance heating so as not to cool excessively the cooled region of the testpiece.

When electric resistance heating is proceeding while the end portions of the testpiece are being cooled, the speed of rise in temperature of the cooled region is slower than that of the non-cooled region. Accordingly, if cooling is continued until the non-cooled region is heated to a target temperature, the temperature of the cooled region will not rise to the target temperature even when the temperature of non-cooled region is already at the target level.

It requires that the temperature of the cooled region rises to a target level simultaneously with that of the non-cooled region of the testpiece. For this reason, cooling needs to be stopped as soon as the non-cooled region is heated up to a predetermined temperature so that a rise in the temperature of the cooled region is sped up through transfer of heat from the non-cooled region already at high temperature to the end portions of the testpiece and heating due to contact resistance between the electrodes and the testpiece.

Figure 8:
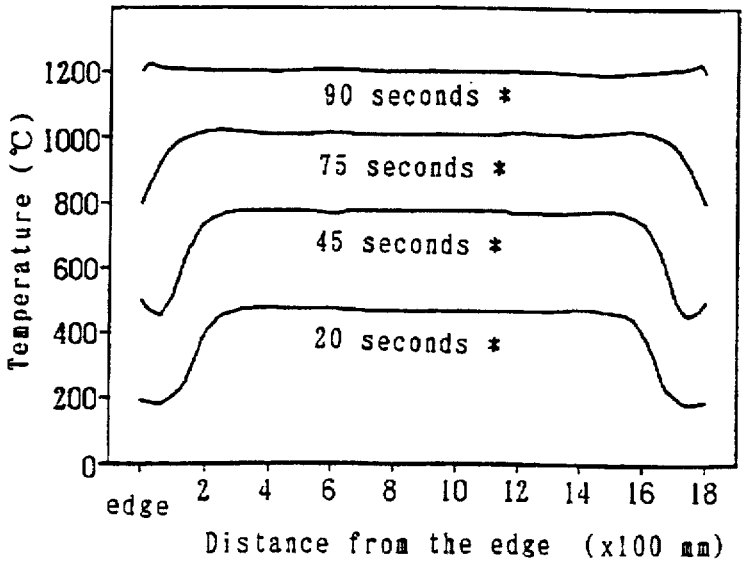
FIG. 8 is a graph showing an example of temperature variation in the longitudinal direction of a steel billet when the billet is heated by the electric resistance heating device while respective ends of the billet are cooled and such cooling is stepped before termination of heating.

FIG. 8 is a graph showing an example of variation in temperature along the longitudinal direction of the testpiece when it was heated while the end portions were cooled and cooling was stopped before the termination of heating.

Electric resistance heating was applied to a testpiece by impressing current at 28000 A for 90 sec. using a billet of S45C steel according to JIS, 50 mm in diameter and 1800 mm in length, as the testpiece. Prior to the start of electric resistance heating, cooling water was sprayed on the surface at respective ends of the testpiece at the rate of 15 l/min. and on the circumferential surface of the testpiece within 60 mm (1.2×diameter of the testpiece) from the respective ends of the testpiece at the rate of 2.5 l/min. and after 65 sec. from the start of electric resistance heating, cooling was stopped. FIG. 8 shows the results of temperature distribution measurement taken along the longitudinal direction of the testpiecec by a thermocouple embedded under the surface of the testpiece after the lapse of 20 sec., 45 sec., 75 sec., and 90 sec., respectively, from the start of energization of the testpiece. The graph shows that a target temperature of 1200° C. was attained throughout the whole length of the testpiece as a result of cooling being stopped 25 sec. prior to the termination of electric resistance heating.

Since the timing of stopping the cooling operation varies depending on such factors as heating temperature, the grade and dimensions of a testpiece, the contact surface area between the testpiece and electrodes etc., it is necessary to determine beforehand from experiment when to stop cooling in the course of heating.

Hereafter, the effect of the present invention is more specifically explained by way of examples of the preferred embodiments.

DESCRIPTION OF THE PREFERRED EMBODIMENTS

FIG. 1 is a schematic view showing an example of an apparatus used for practicing the method of manufacturing of the invention.

In this example, use of an electric resistance heating unit with a cooling device indicated by reference numeral (b-2) as a heating means is preferred. The electric resistance heating unit with the cooling device is explained in detail in the foregoing FIG. 6.

A piercer for forming a hollow billet and a cross-rolling mill for providing the hollow steel bar with both an outside diameter reduction working and a wall thickness sizing working are installed as explained in the foregoing. There is no need of restricting the shape of respective rolls employed in the cross-rolling mill of the invention to any particular geometry, but rolls without such a hump as each of the rolls of Assel mill are provided with are preferred.

The reason for this is that the amount of reduction in the outside diameter of a workpiece is restricted by the height of a hump, making it difficult to provide an appropriate working for reduction in the outside diameter according to the dimensions of the workpiece.

The apparatus shown in FIG. 1 was employed to carry out the production of a hollow steel bar according to the invention. The steel billet A1 was heated to a predetermined temperature in a reheating furnace of gas combustion type (b-1) or an electric resistance heating unit (b-2), the heated billet A1 was pierced by a piercer provided with rolls 15 and a plug 2 positioned in the core of the heated billet A1 as shown in FIG. (*c*), forming a hollow billet A2, and the hollow billet A2 into which a mandrel 3 with lubricant applied thereon was inserted, was rolled by a cross-rolling mil provided with three rolls 1, forming a hollow steel bar A3, namely, the product.

Figure 2B:
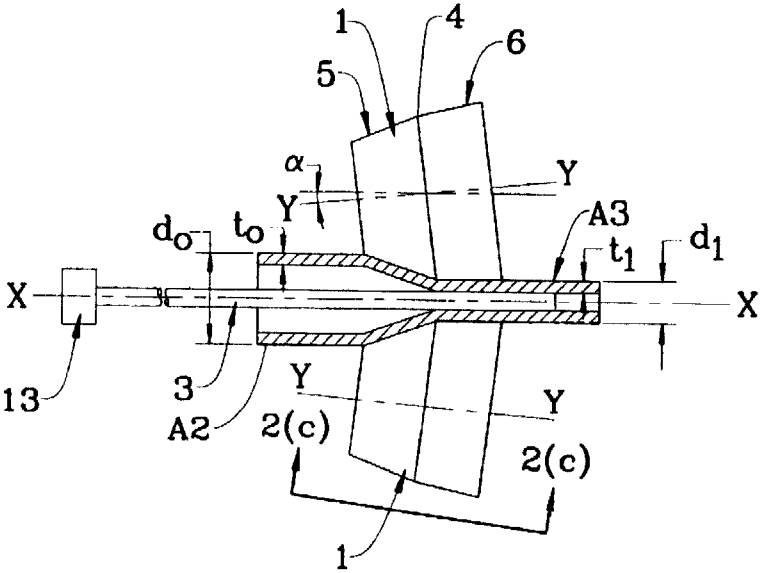
FIG. 2(*a*) is a schematic view showing a hollow steel billet formed by a piercer having a mandrel inserted in the bore thereof being rolled on a cross-rolling mill according to the invention.
Figure 2C:
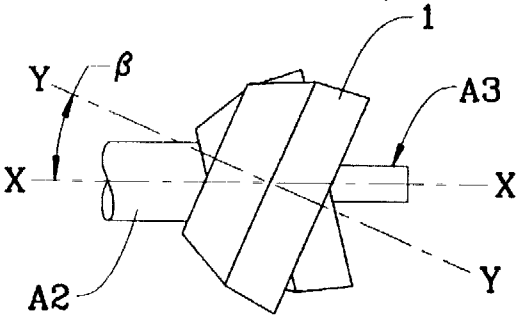
Figure 2A:
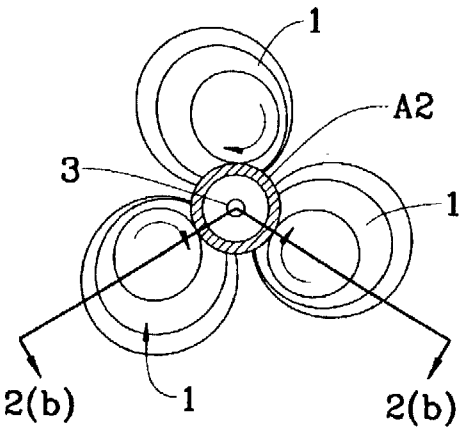
Figure 3A:
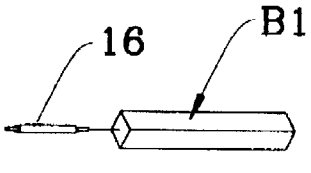
FIGS. 3(*a*), 3(*b*), 3(*c*), 3(*d*) and 3(*e*) together constitute a flow diagram showing a conventional method of manufacturing a hollow steel bar by a mechanical working wherein a hollow billet workpiece is formed by drilling a bore in a square steel billet using a drill, a core bar is inserted into the hollow billet, and the heated hollow billet with the core bar inserted therein is rolled through a grooved roll line, producing a hollow steel bar.
Figure 3B:
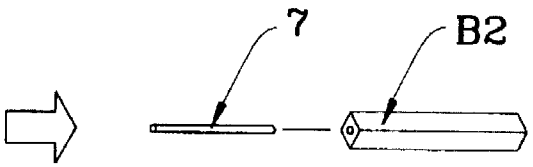
Figure 3C:
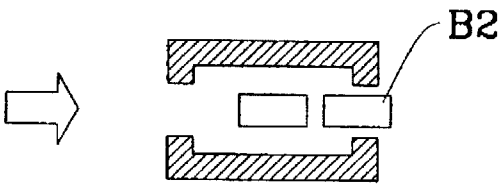
Figure 3D:
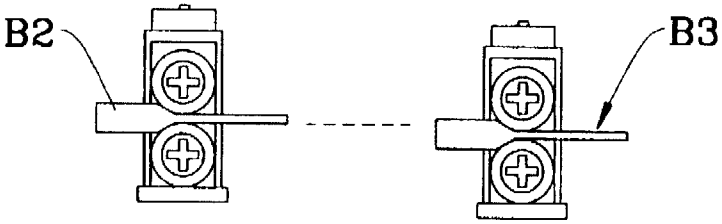
Figure 3E:
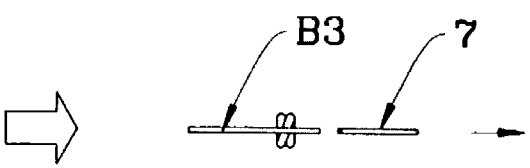
Figures 4A, 4B, 4C, 4D, 4E, 4F, 4G:
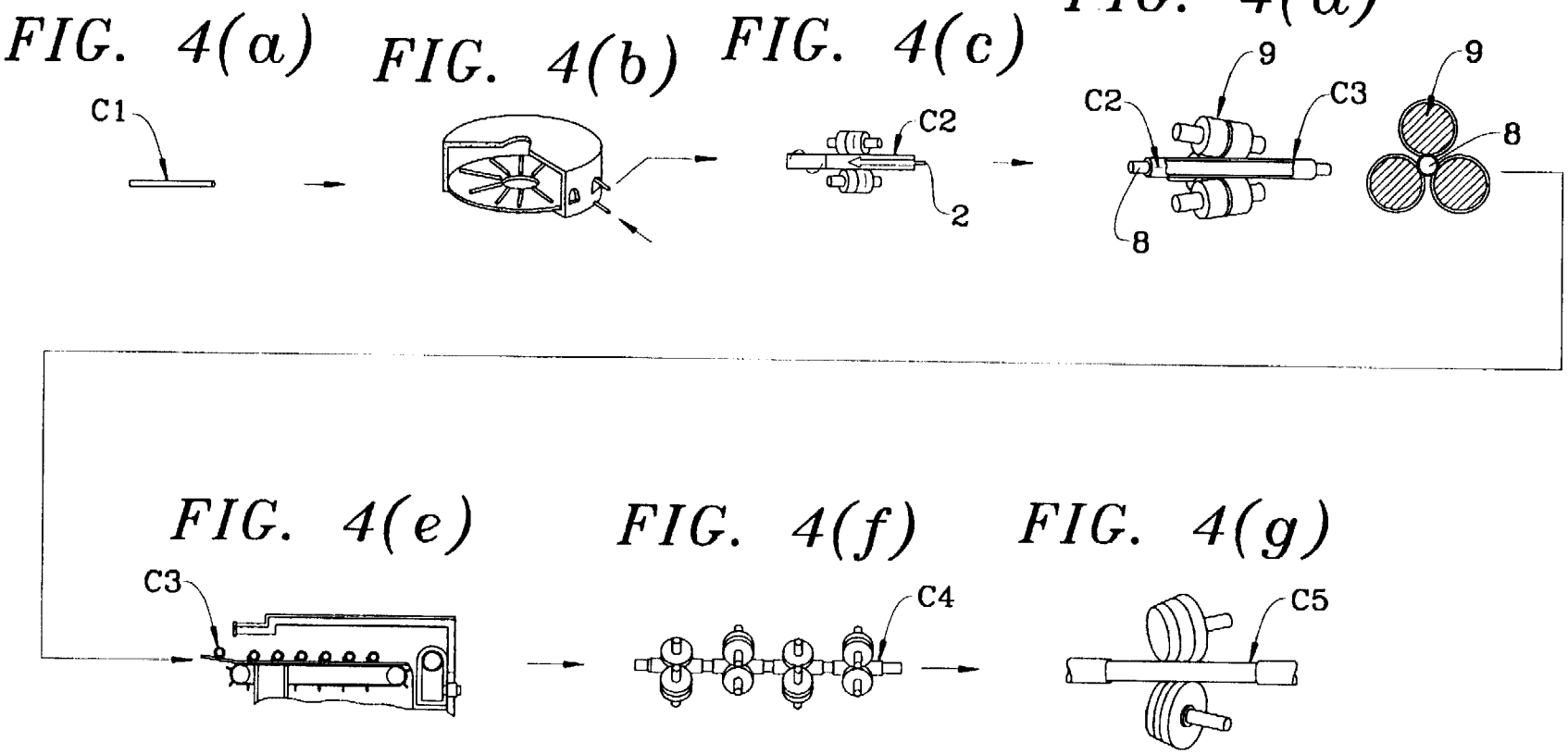
FIG. 4 is a flow diagram showing a conventional method of manufacturing a seamless tube wherein a seamless tube is produced by use of a piercer, Assel mill, a sinking mill, and a rotary sizer.
Figure 5:
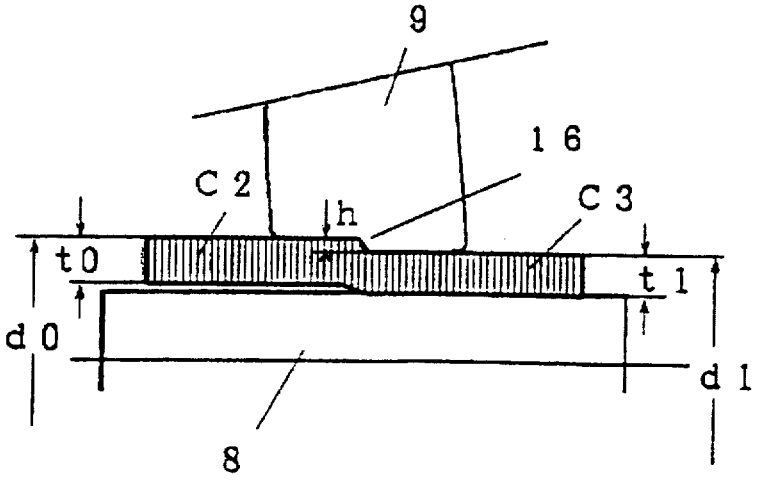
FIG. 5 is a schematic view showing a workpiece being rolled by Assel mill.

FIG. 2 is a schematic view illustrating a cross-rolling mill. FIG. 2(*a*) is a front elevation viewed from the inlet side of the mill showing the hollow billet A2 being rolled, FIG. 2(*b*) a sectional view taken on the line A—A in FIG. 2(*a*), and FIG. 2(*c*) a sectional view taken on the line B—B in FIG. 2(*b*). A mandrel 3 is freely rotatably interlocked with a thrust block 13 means for moving the mandrel back and forth, enabling the adjustment of the mandrel forward and backward along a pass center X—X. During rolling, the mandrel is allowed to move forward at a predetermined ratio against the feed rate of the workpiece. Rolls 1 are provided each with a gorge 4 in the middle part of the surface thereof, an inlet section and an inlet surface 5 in a substantially smooth truncated cone shape with the diameter of the roll gradually reduced toward one end of the shaft of the roll on the inlet side of the gorge 4 in the rolling direction, and an outlet section and an outlet surface 6 in a substantially smooth truncated cone shape with the diameter of the roll gradually increased toward the other end of the shaft of the roll on the outlet side of the gorge in the rolling direction. Respective rolls 1 are disposed substantially at an equidistance from each other around a pass line X—X for of hollow billet A2 and the hollow bar A3 at a predetermined cross angle $\alpha$ and a predetermined feed angle $\beta$ and driven for rotation by a drive source (not shown) in the direction of the arrows, respectively, as shown in FIG. 2(*a*).

Use of rolls 1, each having an inlet surface and an outlet surface and formed in the shape of a barrel with the diameter of the roll gradually reduced toward the respective ends of the shaft of the roll on respective sides of a gorge 4 is acceptable. Also use of another type of roll with the roll diameter gradually increased toward one end of the shaft on the inlet surface side of a gorge 4 and with the roll diameter gradually reduced toward the other end of the shaft on the outlet side of the gorge 4 in the rolling direction is acceptable.

Supplementary explanation on deformation of the hollow billet being rolled is given hereafter.

During rolling operation without use of the mandrel, both the outside diameter and inside diameter of the hollow billet A2 are reduced by three rolls; whereupon the wall thickness $t_1$ after rolling tends to increase generally to a somewhat higher value than the wall thickness to before rolling. Accordingly, a wall thickness to outside diameter ratio t/d after reduction in the outside diameter will increase from that of the workpiece before rolling. However, the results of tests conducted by the inventor of the present invention indicate that, in strict terms, variation in the $t_1$ value is related to $t_0/d_0$ value and Rd and the $t_1$ value may be smaller than the $t_0$ value depending upon combination of $t_0/d_0$ and Rd although $t_1/d_1$ is still greater than $t_0/d_0$.

In the method according to the invention using a mandrel, as reduction in the inside diameter proceeds, the inner surface of a hollow billet finally comes in contact with the mandrel, starting reduction in the wall thickness. Thereafter, dimensional variation in a spiral fashion occurring on the inner surface of the workpiece in the first half stage of rolling is corrected by the mandrel coming in contact with the inner surface, improving dimensional accuracy.

EXAMPLE 1

Hollow steel bars were produced by the method according to the invention under the conditions stated hereafter using a set of apparatuses including a reheating furnace of gas combustion type as shown in FIG. 2(*b*-1) as a heating means; under the same conditions, hollow steel bars were produced by a cross-rolling method without use of an inner surface sizing tool and with use of a plug as an inner surface sizing tool, respectively, to provide examples for the purpose of comparison:

Workpiece material: round billet made of S45C steel dimensions: 50 mm in diameter, and 1800 mm in length Heating heating method: gas combustion type heating temperature: 1200° C.

Piercing by a Piercer dimensions after piercing (hollow billet): diameter $d_0$: 50 mm wall thickness to: 10 mm length $l_0$: 2800 mm ($t_0/d_0$=0.2)

grade of plug: SKID 61 lubricant: graphite lubricant applied to the plug

Cross-rolling diameter of a roll at the gorge thereof: 180 mm revolutions of a roll: 150 rpm roll feed angle $\beta$: 12° roll cross angle $\alpha$: 3° grade of mandrel: SKD 61 speed of mandrel movement: 25% of workpiece feed rate in the rolling direction lubricant: graphite lubricant applied to the mandrel.

Hollow steel bars with the outside diameter in the range of 22.5–40 mm were produced under the conditions stated as above by varying the diameter of the mandrel in the range of 4.5–20 mm as shown in Table 1.

TABLE 1

| Test-piece NO. | Hollow Piece to/do = 0.2 Outside Diameter do (mm) | Wall Thickness to (mm) | Diameter of inner surface sizing tool (mm)** | Dimentions after Rolling Outside Diameter $d_1$ (mm) | Wall Thickness $t_1$ (mm) | Reduction of outside Diameter Rd (%) | Reduction of Thickness Rt*** (%) | Rt/Rd | After Rolling $t_1/d_1$ | Roundness variation (mm) | Quality of internal surface | Polygonalation | Remarks |
|---|---|---|---|---|---|---|---|---|---|---|---|---|---|
| 1 | 50 | 10 | 18.0 (M) | 40.0 | 11.0 | 20 | −10 | −0.500 | 0.28 | 0.12 | Good | None | Present Invention |
| 2 | " | " | 14.0 (M) | 35.0 | 10.5 | 30 | −5 | −0.167 | 0.30 | 0.10 | " | " | |
| 3 | " | " | 10.2 (M) | 30.0 | 9.9 | 40 | 1 | 0.025 | 0.33 | 0.09 | " | " | |
| 4 | " | " | 6.0 (M) | 25.0 | 9.5 | 50 | 5 | 0.125 | 0.38 | 0.11 | " | " | |
| 5 | " | " | 4.5 (M) | 22.5 | 9.0 | 55 | 10 | 0.181 | 0.40 | 0.12 | " | " | |
| 6 | " | " | —* | 40.0 | 11.4 | 20 | — | — | 0.29 | 0.50 | Good | None | Comparative example |
| 7 | " | " | —* | 35.0 | 11.7 | 30 | — | — | 0.33 | 0.70 | " | " | |
| 8 | " | " | —* | 30.0 | 10.7 | 40 | — | — | 0.36 | 1.40 | " | " | |
| 9 | " | " | —* | 25.0 | 10.0 | 50 | — | — | 0.40 | 1.45 | " | " | |
| 10 | " | " | —* | 22.5 | 9.5 | 55 | — | — | 0.42 | 1.50 | " | " | |
| 11 | " | " | 20.0 (P)* | 40.0 | 10.0 | 20 | 0 | 0 | 0.25 | 0.11 | seizure | None | |
| 12 | " | " | 14.0 (P)* | 35.0 | 10.5 | 30 | −5 | −0.167 | 0.30 | 0.13 | " | " | |

NOTE
*indicates cases outside the scope of the present invention
**(M): mandrel (P): plug
***negative Rt value indicates an increase of wall thickness of testpieces after rolling By way of examples for comparison, hollow steel bars with the outside diameter in the range of 22.5–40 mm were produced without use of an inner surface sizing tool, and same with the outside diameter 35 mm and 40 mm, respectively, were produced using a plug with the diameter 14 mm and 20 mm, respectively, as an inner surface sizing tool. The hollow steel bars produced were cut in half lengthwise, and variation in roundness of the inside diameter (d=max. inside diameter−min. inside diameter) was measured to evaluate dimensional accuracy of the hollow steel bars produced.

Also, visual observation of the sectional surface of the products was made to check occurrence of polygonalation. Further, the hollow steel bars were cut along the plane of the central axis to observe the condition of the internal surface thereof.

The reason for using the roundness of the inside diameter in evaluating dimensional accuracy is that, in the case of a cross-rolling, the dimensional accuracy for the outside diameter is fairly better than same for the inside diameter, and the dimensional accuracy of a product can be practically judged by that of the inside diameter.

The results of observation of the internal surface and measurement of roundness are shown in Table 1.

As is clear from Table 1, the examples of the embodiments of the invention demonstrate that the dimensional accuracy of the inside diameter is satisfactory and seizure did not occur at all between the inner surface of respective hollow bars and the mandrel.

On the other hand, in the case of testpieces numbered from 6 to 10 for which an inner surface sizing tool was not used, the dimensional accuracy of the inside diameter after rolling was found poor, and as an outside diameter reduction ratio (Rd) increased, deterioration in the dimensional accuracy became more conspicuous.

In the case of testpieces numbered 11 and 12 for which a plug was used as an inner surface sizing tool, the dimensional accuracy of the inside diameter was found satisfactory, but seizure occurred between the hollow billet and the plug past a point about 800 mm from the inlet of the rolling zone, causing a drive motor for rolling to step due to the overload. It can be said from this that a rolling process with use of a plug is not suited for production of long hollow bars (length: 1 m or longer) in great demand in the market place.

EXAMPLE 2

Hollow steel bars were produced under the same condition as that in Example 1 except for $t_o/d_o$ being varied from 0.09 to 0.15 and a ratio of wall thickness reduction to outside diameter reduction (Rt/Rd) being varied from −1.97 to 0.55. The hollow steel bars thus produced were cut in half lengthwise for measuring the roundness of the inside diameter and checking visually the occurrence of polygonalation.

The hollow bars were then cut longitudinally for visual observation of the internal surface condition; the results are shown in Table 2.

TABLE 2

| Test-piece NO. | Hollow Piece Outside Diameter do (mm) | Wall Thickness to (mm) | to/do | Diameter of Plug (mm) | Dimentions after Rolling Outside Diameter $d_1$ (mm) | Wall Thickness $t_1$ (mm) | Reduction of utside Diameter Rd (%) | Reduction of Thickness Rt** (%) | Rt/Rd | After Rolling $t_1/d_1$ | Roundness variation (mm) | Quality of internai surface | Polygonalation | Remarks |
|---|---|---|---|---|---|---|---|---|---|---|---|---|---|---|
| 13 | 50 | 4.5 | 0.09* | 14.4 | 30.0 | 7.8 | 40 | −73 | −1.83 | 0.26 | 3.5 | Good | Yes | Com. |
| 14 | " | 5.0 | 0.10 | 15.6 | 32.5 | 8.45 | 35 | −69 | −1.97 | 0.26 | 0.65 | " | None | Present |

TABLE 2-continued

| Test-piece NO. | Hollow Piece: Outside Diameter do (mm) | Hollow Piece: Wall Thickness to (mm) | to/do | Diameter of Plug (mm) | Dimentions after Rolling: Outside Diameter $d_1$ (mm) | Dimentions after Rolling: Wall Thickness $t_1$ (mm) | Reduction of utside Diameter Rd (%) | Reduction of Thickness Rt** (%) | Rt/Rd | After Rolling $t_1/d_1$ | Roundness variation (mm) | Quality of internai surface | Polygonalation | Remarks |
|---|---|---|---|---|---|---|---|---|---|---|---|---|---|---|
| 15 | " | 6.0 | 0.12 | 16.8 | 35.0 | 9.1 | 30 | −52 | −1.73 | 0.26 | 0.12 | " | " | Invention |
| 16 | " | " | " | 14.4 | 30.0 | 7.8 | 40 | −30 | −0.75 | 0.26 | 0.13 | " | " | |
| 17 | " | 7.5 | 0.15 | 16.8 | 35.0 | 9.1 | 30 | −21 | −0.70 | 0.26 | 0.11 | " | " | |
| 18 | 62 | 4.0 | 0.23 | 17.4 | 44.0 | 13.3 | 30 | 5 | 0.17 | 0.30 | 0.09 | " | " | |
| 19 | 70 | " | 0.20 | 16.8 | 42.0 | 12.6 | 40 | 10 | 0.25 | 0.30 | 0.08 | " | " | |
| 20 | " | " | " | 14.0 | 35.0 | 10.5 | 50 | 25 | 0.50 | 0.30 | 0.25 | " | " | |
| 21 | " | " | " | 12.5 | 31.5 | 9.5 | 55 | 32 | 0.55* | 0.30 | 0.45 | Bad | " | Com. |

NOTE
*indicates a case outside the scope of the present invention
**negative Rt value indicates an increase of wall thickness of testpieces after rolling
Com.: Comparative example As shown clearly in Table 2, the smaller the $t_0/d_0$ value is, the higher the risk of polygonalation occurring becomes. In realization of stable rolling without polygonalation, $t_0/d_0$ value needs to be 0.1 or above, preferably, 0.12 or above.

In case of wall thickness reduction (Rt) becoming excessively large when a workpiece is rolled with hump-less rolls, reduction in the wall thickness takes the form of deformation of the outside diameter due to expansion, causing dimensional variation undulating in a spiral fashion. Examination of dimensional variation in relation to a ratio of wall thickness reduction to outside diameter reduction (Rt/Rd) indicates that the dimensional accuracy deteriorates in a pronounced way when Rt/Rd is 0.55.

EXAMPLE 3

Piercing and rolling of testpieces were carried out under the same condition as that for No. 3 testpiece shown in Table 1 in the case of Example 1 except for use of an electric resistance heating unit provided with a cooling device at respective ends of a testpiece.

Electric resistance heating and cooling conditions were as follows:

electrode material: copper and tungsten alloy protruding surface of an electrode: spherical surface of R at 250 mm contact pressure at the tip of an electrode: 100 kgf impressed current and time length: 28000 A, for 90 sec.

water cooled region: surface at respective ends of testpiece and (external surface of electrode tips included) circumferential surface of testpiece within 60 mm from both ends of testpiece (1.2 times outside diameter of testpiece)

rate of water supply: 15 l/min. for end surfaces of testpiece and electrode tips 2.5 l/min. for circumferential surface of test piece cooling time: from before heating to after 65 sec. from the start of electric resistance heating Under the condition stated as above, the heating, piercing, and cross-rolling of a testpiece were carried out.

After cross-rolling the testpiece, a hollow bar was acid cleaned, and cut across the middle part thereof to measure the roundness of the inside diameter, observe visually the condition of the internal surface, and check occurrence of polygonalation.

Then, a normalizing process was applied to a half piece of the hollow steel bar by holding same at 850° C. for 20 min. Testpieces for the impact test according to JIS No. 1 (width: 5 mm height: 10 mm V notch) were taken from the center portion of the wall in the middle part of the normalized bar piece and a hollow bar piece as rolled, respectively, and subjected to impact tests at room temperature.

Also, testpieces for the impact test according to JIS No. 1 were taken from the middle part lengthwise of a normalized testpiece and a testpiece as rolled, respectively, of No. 3 testpiece obtained by the heating method of gas combustion type, and follow workpiece obtained by the electric resistance heating method, respectively; said testpieces being subjected to the impact test by varying temperature in the range from 80° C. to 98° C. The result of observation of the internal surface of the hollow steel bars testpieces and the impact test on same conducted at room temperature are shown table 3.

TABLE 3

| Test-piece NO. | Heating Method | Water Cooling | Quality of Internal Surface | Polygonalation | Value of Charpy Impact Test (J/cm²) as rolled Edge 1 | Edge 2 | Edge 3 | Edge 4 | Center | Normalized Edge 1 | Edge 2 | Edge 3 | Edge 4 | Center |
|---|---|---|---|---|---|---|---|---|---|---|---|---|---|---|
| 3 | Gas | — | Good | None | 25 | 26 | 27 | 26 | 26 | 38 | 38 | 38 | 37 | 38 |
| 22 | Elect. | Yes | " | " | 39 | 38 | 37 | 38 | 38 | 50 | 51 | 50 | 50 | 50 |

NOTE
position of V notch on a testpiece
Edge 1: 50 mm from the edge,
Edge 2: 100 mm from the edge,
Edge 3: 150 mm from the edge,
Edge 4: 200 mm from the edge
Gas: Heating funace by gas
Elect.: Heating by electricity As shown clearly in Table 3, an impact test value of No. 22 testpiece obtained by the electric resistance testing method of the inventions about 38 J/cm², equal to that for No. 3 testpiece as normalized.

This means that when the electric resistance heating method is adopted, a normalizing process can be dispensed with.

As stated above, the electric resistance heating method can improve the toughness property of hollow steel bars appreciably because this method enables steel billet workpieces to be heated to a target temperature in a short time, and consequently, crystal growth hardly occurs during heating.

In processing a hollow steel billet by the method and apparatus for manufacturing a hollow bar, $t_1/d_1$ is increased mainly by reducing the outside of the workpiece through rolling on a cross-rolling mill using a mandrel as an inner surface sizing tool, and the inside diameter is finished with high dimensional accuracy by simultaneously achieving wall thickness draft with use of the inner surface sizing tool.

In addition, as polygonalation and dimensional variation in a spiral pattern can be avoided, a process for dimensional correction becomes unnecessary with this method. Thus, the manufacturing method and apparatus of the invention make it possible not only to produce thick-walled hollow steel bars of small diameter via fewer steps of processing at low cost but also to produce the product having high toughness by adoption of the electric resistance heating method.

What is claimed is:

1. A hollow steel bar manufacturing method comprising steps of:

heating a steel billet;

piercing the heated billet with a piercer to form a hollow workpiece meeting a condition expressed by the following formula (1);

inserting a mandrel serving as an inner surface sizing tool into the hollow workpiece; and cross-rolling the hollow workepiece having the mandrel inserted in the bore by a cross-rolling mill having three rolls arranged around a pass line for a diameter reduction process and a wall thickness sizing process meeting a condition expressed by the following formula (2);

$$t_0/d_0 \geqq 0.1 \quad (1)$$

$$Rt < 0.55Rd \quad (2)$$

where $t_0$: the wall thickness of the hollow workpiece before cross-rolling $d_0$: the outside diameter of the hollow workpiece before cross-rolling Rt: wall thickness reduction (%) expressed by $$Rt = (t_0 - t_1)/t_0 \times 100$$

Rd: outside diameter reduction (%) expressed by $$Rd = (d_0 - d_1)/d_0 \times 100$$

$t_1$: the wall thickness of the steel bar after cross rolling $d_1$: the outside diameter of the hollow steel bar after cross rolling.

2. The hollow steel bar manufacturing method according to claim 1, wherein the workpiece meets a condition expressed by the following formula (3):

$$t_0/d_0 \geqq 0.12 \quad (3)$$

where $t_0$ and $d_0$ are the same as defined in claim 1.

3. The hollow steel bar manufacturing method according to claim 1, wherein the diameter reduction process and the wall thickness sizing process meets a condition expressed by following formula (4):

$$Rt < 0.5Rd. \quad (4)$$

where

Rt and Rd are the same as defined in claim 1.

4. The hollow steel bar manufacturing method according to claim 1, wherein the workpiece meets conditions expressed by following formula (3) and formula (4):

$$t_0/d_0 \geqq 0.12 \quad (3)$$

$$Rt < 0.5Rd. \quad (4)$$

$t_0$, $d_0$, Rt and Rd are the same as defined in claim 1.

5. The hollow steel bar manufacturing method according to claim 1, wherein a steel billet is heated through direct energization by electrodes, protruding tips of which are tightly pressed against, and connected to, the surfaces at respective ends of the steel billet.

6. The hollow steel bar manufacturing method according to claim 5, wherein heating by energization of a steel billet is commenced by connecting the protruding tips of respective electrodes to the surfaces at respective ends of the round steel billet while cooling the surfaces at both ends of the steel billet and the circumferential surface thereof up to a distance of 0.3–2.5 times the outside diameter of the steel billet from the respective ends; such cooling being stopped so as not to excessively cool said cooled parts of the steel billet prior to completion of the heating by energization so that the steel billet is heated to a target temperature.

7. An apparatus for manufacturing hollow steel bars comprising:

means for heating a steel billet through energization, provided with electrodes, protruding tips of which are tightly pressed against the surface at respective ends of the steel billet, means for cooling the respective ends of the steel billet, a piercer for piercing the steel billet after heating for forming a hollow workpiece, a cross-rolling mill having three rolls arranged around a pass line for reducing the outside diameter and sizing the wall thickness of the hollow workpiece having a mandrel inserted therein.

* * * * *